US005713826A

United States Patent [19]

West

[11] Patent Number: 5,713,826

[45] Date of Patent: Feb. 3, 1998

[54] VERTICAL BASKET CENTRIFUGE WITH FEED ACCELERATION AND A REMOVABLE LINER

[75] Inventor: James D. West, Bellingham, Mass.

[73] Assignee: Waterlink, Inc., Canton, Ohio

[21] Appl. No.: 646,033

[22] Filed: May 7, 1996

[51] Int. Cl.[6] ..... B04B 7/12; B04B 11/00

[52] U.S. Cl. ..... 494/45; 494/56; 494/67

[58] Field of Search ..... 494/43, 45, 56, 494/60, 63, 64, 65, 67, 80, 81, 85, 50, 51; 210/377, 380.1

[56] References Cited

U.S. PATENT DOCUMENTS

| | | | |
|---|---|---|---|
| 426,275 | 4/1890 | Hult et al. | 494/67 X |
| 780,444 | 1/1905 | Pihl | 494/67 |
| 1,239,734 | 9/1917 | Sloan et al. | 494/45 |
| 1,336,722 | 4/1920 | Behr . | |
| 1,761,593 | 6/1930 | Sharples . | |
| 2,083,809 | 6/1937 | Asch | 494/65 X |
| 2,114,778 | 4/1938 | Fillinger | 210/377 X |
| 3,437,209 | 4/1969 | Evans | 210/380.1 X |
| 3,788,470 | 1/1974 | Pelmulder et al. . | |
| 3,799,353 | 3/1974 | Pause . | |
| 3,963,175 | 6/1976 | Daubman et al. | 494/80 X |
| 4,052,303 | 10/1977 | Hultsch et al. . | |
| 4,193,874 | 3/1980 | Gerteis . | |
| 4,608,040 | 8/1986 | Knelson | 494/29 X |
| 4,983,156 | 1/1991 | Knelson | 494/80 X |
| 5,222,933 | 6/1993 | Knelson et al. | 494/67 X |
| 5,368,541 | 11/1994 | Knelson | 494/80 X |
| 5,370,600 | 12/1994 | Fitch, Jr. et al. | 494/67 X |

FOREIGN PATENT DOCUMENTS

| | | | |
|---|---|---|---|
| 8973 | 9/1894 | Switzerland | 494/80 |

*Primary Examiner*—Charles E. Colley
*Attorney, Agent, or Firm*—Sand & Sebolt

[57] ABSTRACT

A centrifuge of the type having a rotary basket with a bottom wall, side wall and a top wall with a central opening therein includes a liquid feed pipe extending into the basket through the top opening to a point spaced above the basket bottom wall at the rotary axis thereof for conducting a feed liquid into the basket. A feed accelerator projects from the basket bottom wall opposite the feed pipe. The accelerator rotates with the basket so that, the accelerator will impart radial and angular acceleration to the liquid issuing from the feed pipe so that that liquid is redirected and accelerated toward the basket side wall. The centrifuge also incorporates a liquid drain in the basket bottom wall adjacent to the rotary axis of the basket for draining liquid from the basket when the rotation of the basket is stopped.

19 Claims, 2 Drawing Sheets

VERTICAL BASKET CENTRIFUGE WITH FEED ACCELERATION AND A REMOVABLE LINER

FIELD OF THE INVENTION

This invention relates to a centrifuge or centrifugal filter. It relates more particularly to a manually cleaned centrifuge of the type having a vertical basket.

BACKGROUND OF THE INVENTION

In general, a centrifuge or centrifugal filter comprises a rotary basket or drum which may be rotated at a high speed to centrifugally cast a suspension of particulate material in a liquid phase against a cup-like liner in the rotating basket. The liquid phase is discharged through an opening in the top of the basket, while the solid phase is retained on the liner as a relatively dense layer or cake.

A vertical basket centrifuge is one whose basket or drum rotates about a vertical axis and we are concerned here especially with a centrifuge of this type whose basket has a relatively small diameter, i.e., 24 inches or less, and which must be cleaned manually by removing the settled solids after the basket has stopped rotating. A typical conventional centrifuge such as this as shown in FIGS. 1A and 1B. It includes a basket or drum B which contains a cup-like solid liner L. The basket is rotated by a driven shaft S at a high speed, e.g., 1,500 to 2,000 RPM. Feed liquid is introduced into the rotating basket B through a feed pipe F, F' and the liquid forms a pool P adjacent to the radially outer wall of the liner L. The liquid phase of the feed liquid is able to escape from the rotating basket B through an opening O in the top of the basket, while centrifugal force drives the solid phase of the feed liquid to the liner L where it collects as a solids layer or cake. A centrifuge such as this may be used, for example, to remove metal filings and other debris from lubricating oil so that the oil can be reused.

As shown in FIG. 1A, some feed pipes F deposit feed liquid pumped through the pipe onto the interior surface of the pool P which is rotating more or less at the speed of the rotating basket B. This is a very inefficient method of feeding the liquid into the centrifuge since the only means of accelerating the incoming liquid up to the speed of the basket B is by transferring energy from the liquid pool P, which has essentially the angular velocity of the basket, to the incoming feed liquid which has essentially zero angular velocity. The energy transfer from the rotating liquid pool P to the feed liquid thus results in the pool P losing angular velocity.

Actually, due to inefficient acceleration, most of the liquid fed into the centrifuge after the pool P has formed never reaches the rotation and speed of the basket B. Rather, it slides or skates over the inner surface of the pool P to the top opening O in the basket. The feed liquid thus has minimal residence time in the centrifuge and experiences relatively low centrifugal forces due to the low rotational speeds and small diameters of the liquid pool surface. Since centrifugal force is the driving force for liquid-solid separation in all centrifuges, the separation efficiency of such centrifuges with conventional feed methods is relatively low.

It should be appreciated also that in any centrifuge, the greatest driving force for separation exists at the wall of the centrifuge basket or, more particularly, of the liner L. This is the region of highest angular velocity resulting in the highest centrifugal G-forces on the liquid. In other words, with increasing diameter from the inner surface of the liquid pool P to the outer wall of the liner, the pool moves at greater angular velocity and thus has a greater energy level for the same fixed basket speed. In order for the incoming liquid to migrate to the high G-force regions at the radially outer wall of the liner, the liquid must reach the angular velocities or energy levels of the liquid layers at those outer diameters within the basket B. Because of the feed methods of conventional centrifuges, long residence times are needed to accelerate the feed liquid to those higher speeds. Since the liquid pool P is not a rigid body, "slip" occurs between the radially disposed layers of liquid so that the layers rotate at different speeds, resulting in very inefficient acceleration of the liquid pool P as a whole. Thus, conventional centrifuges of the type with which we are concerned here do not achieve the desired goal of quickly distributing the incoming feed liquid to the outer diameter of the rotating centrifuge basket where the G-forces are highest.

Instead of pumping the feed liquid into the centrifuge basket as just described, some centrifuges of the small, manually cleaned type introduce the feed liquid into the centrifuge basket through an oversized feed pipe to allow for a high through-put with a gravity feed. In other words there is no feed pump; the feed liquid "falls" into the basket under gravity. A centrifuge with an oversized feed pipe F' such as this is illustrated in FIG. 1B. This arrangement results in the feed liquid exiting the feed pipe in a conical "fan" rather than as a solid stream of liquid as shown by the arrows in FIG. 1B. This creates a condition in the centrifuge basket wherein air is entrained in the feed liquid so that air as well as liquid is accelerated to speeds approaching the speed of the rotating basket. This rapidly circulating air, known as "windage" in the industry, can blow through the thin films or sheets of feed liquid issuing from the feed pipe. This phenomenon results in much of the incoming feed liquid being "blown" out of the basket through top opening O as shown by the arrows in FIG. B without ever coming into contact with the liquid pool P.

Another problem with the conventional centrifuge designs illustrated in FIGS. 1A and 1B stems from the fact that the feed pipe F, F' does not penetrate to the full depth of the centrifuge basket B; rather the pipe usually extends only halfway down or less into the basket. Resultantly, the feed liquid entering the basket B is deposited on the liquid pool P halfway up the basket relatively close to the discharge opening O. Resultantly, the liquid has a short residence time in the basket and acquires little angular velocity within the rotating basket. This phenomenon is referred to in the industry as short circuiting.

Finally, the centrifuges with which we are concerned here use solid bowl liners to collect the solids that are separated from the feed liquid. This means that the centrifuge has to be stopped periodically in order to clean the liner with the collected solids or to remove that liner for replacement with a fresh liner. The most common liner is a cup-like design which retains all of the liquid remaining in the centrifuge basket when the centrifuge is turned off. The volume of such residual liquid can be appreciable, particularly for the larger centrifuges. In order to clean the liner, this liquid must be poured out, or in the case of a large basket ladled out, of the liner before the solids can be removed from the liner. This can be a relatively time consuming task and results in longer centrifuge down time.

SUMMARY OF THE INVENTION

Accordingly, It is an object of the present invention to provide an improved centrifuge of the relatively small, manually cleaned type.

Another object of the invention is to provide such a centrifuge which is more efficient than those presently available.

A further object of the invention is to provide a vertical basket centrifuge which maximizes the residence time of the feed liquid in the centrifuge.

A further object of the invention is to provide such a centrifuge which subjects the incoming feed liquid to maximum G-forces for a given rotational speed of the centrifuge.

Still another object of the invention is to provide a centrifuge with a solid basket liner which is self draining when the centrifuge is turned off.

Other objects will, in part, be obvious and will, in part, appear hereinafter. The invention accordingly comprises the features of construction, combination of elements and arrangement of parts which will be exemplified in the following detailed description, and the scope of the invention will be indicated in the claims.

Briefly, my vertical basket centrifuge has a solid basket liner and a reduced diameter feed pipe which extends down into the basket to a point near the bottom thereof so that the incoming feed liquid issues from the feed pipe at a location furthest away from the top opening of the rotating basket through which the liquid phase discharges when the centrifuge is in operation. Located directly under the feed pipe at the bottom of the basket is a feed accelerator which spins with the basket and which imparts angular velocity to the feed stream issuing from the feed pipe thereby causing that liquid to accelerate quickly up to the speed of the rotating basket. Those coupled parts also impart a high radial velocity to the feed liquid which causes that liquid to penetrate the surface of the liquid pool in the rotating basket. This ensures that the feed liquid will be distributed to the outer wall of the basket liner at a location near the bottom of the basket thus maximizing the residence time of the feed liquid in the basket and the time during which the feed liquid is under the influence of the maximum G-forces generated in the radially outer regions of the rotating basket.

As will be seen later, the feed accelerator is shaped and arranged to translate the high axial velocity of the feed stream issuing from the feed pipe into radial velocities which are high enough to enable the feed liquid to penetrate deep into the liquid pool in the rotating centrifuge basket. Also, since the incoming feed liquid issues from the reduced diameter feed pipe at a high velocity, a minimum amount of air is entrained in the liquid before it encounters the accelerator. Thus, there is minimal rotational windage that could carry airborn liquid out of the rotating basket before it can be entrained in the liquid pool present in the radially outer regions of the basket.

Also, as will be described in more detail later, the basket liner includes an opening in its bottom wall to provide clearance for the accelerator. Preferably, the centrifuge basket includes a bottom drain under the accelerator right adjacent to the axis of rotation of the basket so that when the centrifuge is turned off and the basket slows down, any liquid remaining in the basket, or more particularly in the liner therein, will drain away thereby allowing the solids to be removed from the liner right after the centrifuge is turned off. As will be seen later, the centrifuge is constructed so that any such liquid drained away when the centrifuge is stopped does not come into contact with the shaft bearings and other sensitive parts of the centrifuge.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1A:
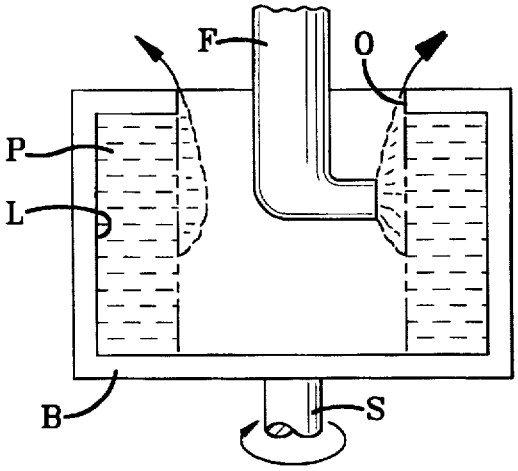
FIG-1A PRIOR ART
FIGS. 1A and 1B, already described, are fragmentary sectional views showing the operation of conventional manually cleaned vertical basket centrifuges.
Figure 1B:
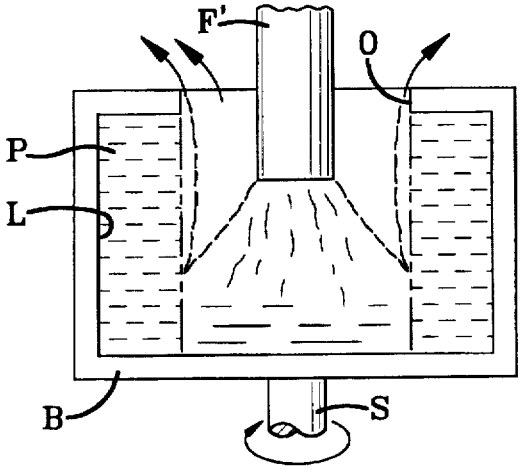
FIG-1B PRIOR ART
Figure 2:
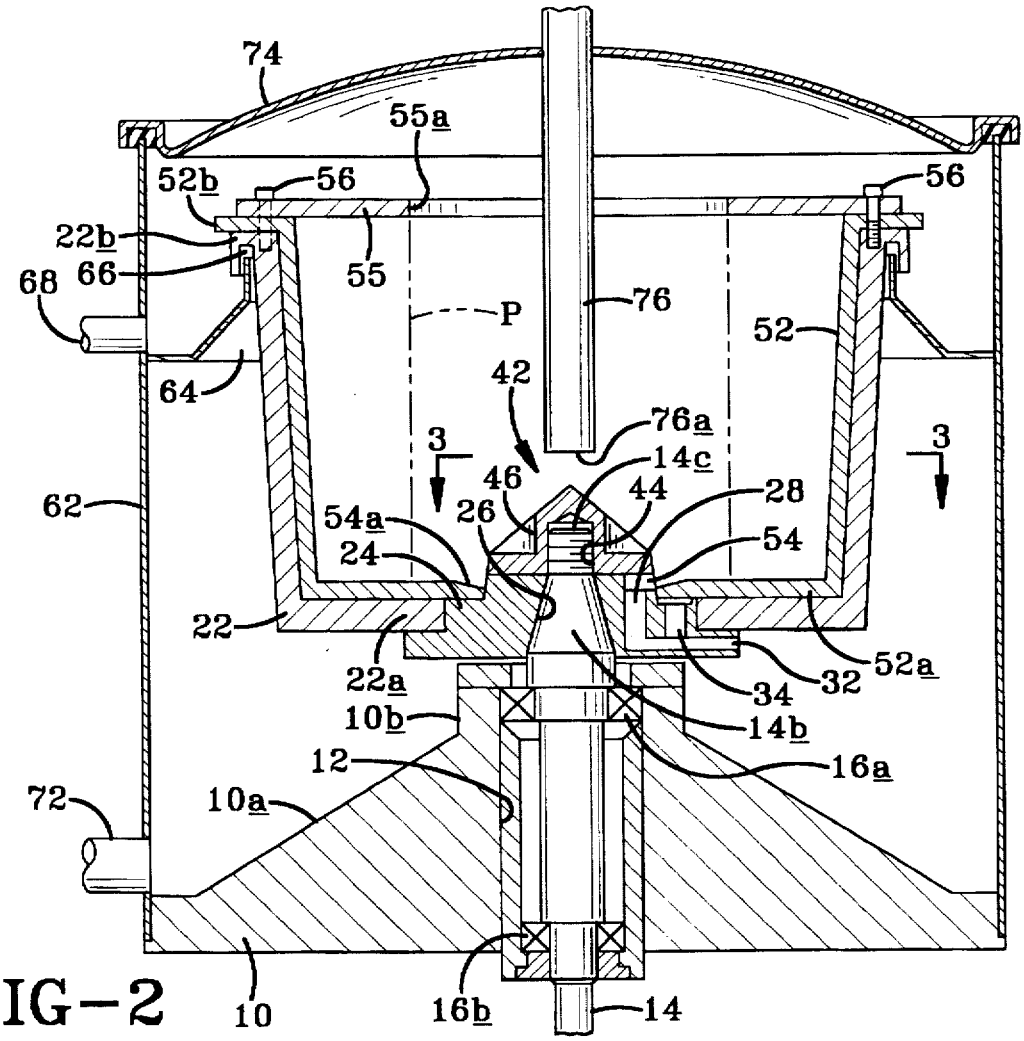
FIG. 2 is a sectional view on a larger scale showing a centrifuge of this type incorporating the invention.

Referring to FIG. 2 of the drawings, my centrifuge comprises a base 10 with a conical upper surface **10*a* and a central mesa 10*b*. The base is provided with a vertical passage 12 which extends up through the mesa 10*b* for accommodating a rotary shaft 14 which is rotatably supported within the passage by upper and lower bearings 16*a* and 16*b*. The lower end 14*a* of shaft 14 projects below base 10** and may be rotated by an electric motor or other suitable means (not shown).

The upper end of shaft 14 which projects above mesa **10*b* has a conical segment 14*b* and a threaded end segment 14*c***.

A cup-like centrifuge basket or bowl 22 is mounted to the upper end of shaft 14 for rotation therewith. Basket 22 has a bottom wall **22*a* with a central thickened hub 24. Hub 24 is formed with a conical passage 26 which is arranged to receive the conical segment 14*b* of shaft 14 so the basket 22** wedgingly seats on the shaft.

Figure 3:
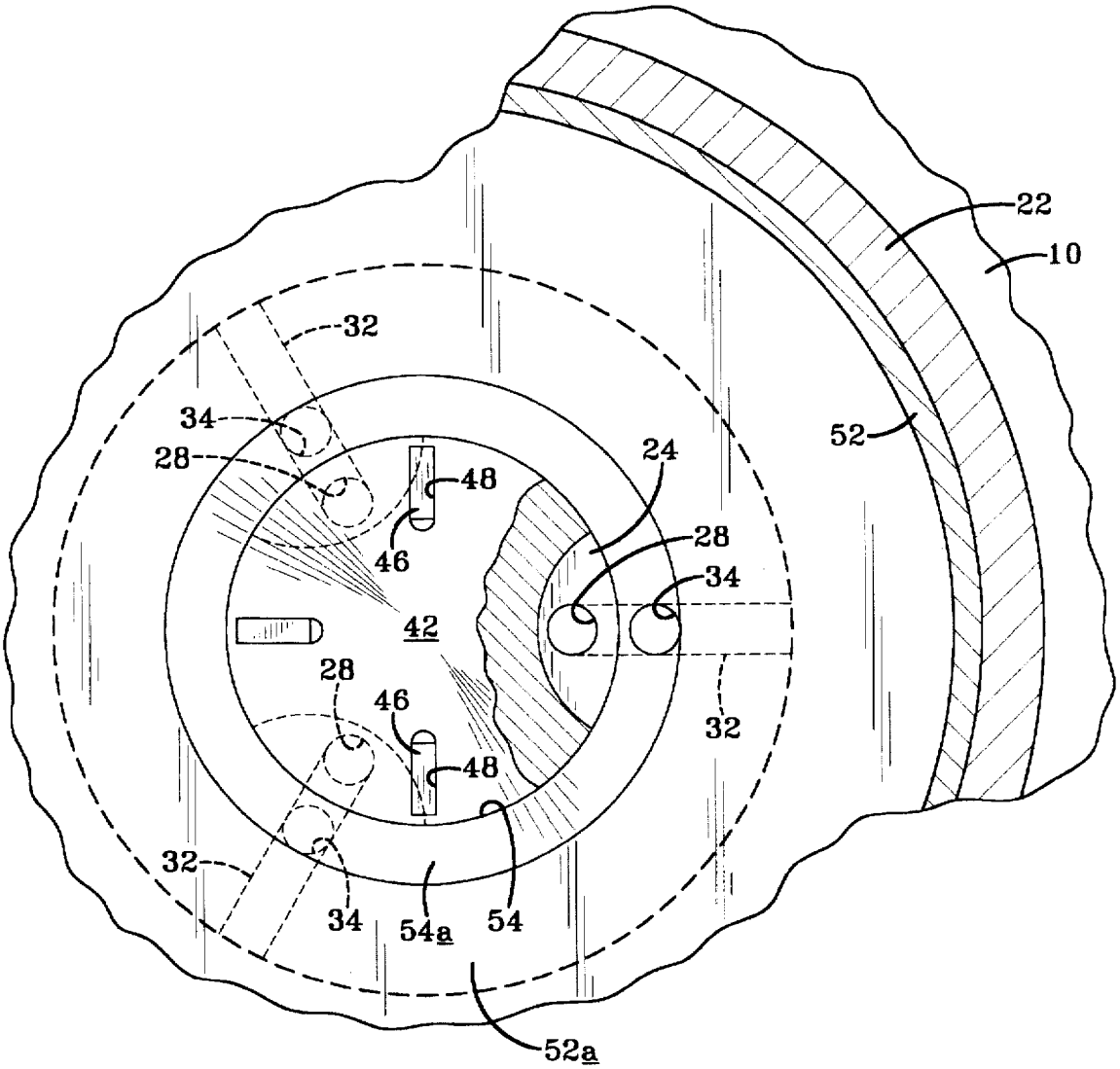
FIG. 3 is a sectional view on a larger scale taken along line 3—3 of FIG. 2.

As shown in FIGS. 2 and 3 of the drawings, three vertical holes 28 are formed in hub 24 at a recessed edge thereof. The upper end of each hole opens into basket B adjacent to the rotational axis of the basket. The lower end of each hole 28 opens into a blind passage 32 which extends radially in from the periphery of hub 24 under basket wall **22*a* so that there is fluid communication from the interior of basket 22 holes 28 to passages 32 outside of the basket. If desired, additional drain holes 34 may be provided in the bottom wall 22*a* of basket 22 radially outboard of holes 28 and which communicate with passages 32. Preferably the radially outer ends of passages 32 are located well outboard mesa 10*b***.

As apparent from FIGS. 2 and 3, a feed accelerator, shown generally at 42, is seated on the hub 24 at the bottom of basket 22. The accelerator is basically a conical nut having an incline in the range of 40°–60°, 50° being preferred. A threaded passage 44 extends in from the flat underside of the nut and which is arranged to receive the threaded end **14*c* of shaft 14. Thus, when the accelerator nut is turned down onto the shaft, it seats against the top of hub 24 and locks basket 22** to the shaft. The illustrated nut is about 4 inches in diameter and about 2 inches high.

The conical surface of accelerator 42 is formed with a circular array of relatively large, i.e., 0.75×0.25×0.5 in., slots 46, each slot having a triangular cross section. The illustrated accelerator has four such slots spaced 90° apart around the vertical axis of the accelerator. The walls of the slots thus form vanes 48 which incline at an angle of about 50° from the horizontal direction.

As shown in FIGS. 2 and 3, basket 22 contains a cup-like solid liner 52 which hugs the walls of basket 22. Liner 52 is more or less conventional except that its bottom wall contains a clearance hole 54 for hub 24 and accelerator 42. If desired, the liner bottom wall **52*a*, may be shaped to provide an annular portion 54*a* around hole 54 which slopes downward toward the hole so that any liquid in the liner will tend to drain downward toward hole 54 and thus to the drainage holes 28 in hub 24**.

Liner 52, like other solid liners of this general type, has a radial flange **52*b* which engages over the rim 22*b* of basket 22. Seated on top of the liner flange 52*a* is a flat annular cover 55. The cover and liner are secured to the basket 22 by a circular array of threaded fasteners 56 which extend down through registering holes in the cover 54 and flange 52*a* and are turned down into threaded vertical holes distributed around the rim of basket 22**.

As shown in FIG. 2, base 10 and basket 22 are surrounded by a cylindrical housing 62 which extends up from the base. Formed on the inside wall of the housing just below the top of basket 22 is an annular gutter 64 which extends from the housing interior wall into a groove 66 in the underside of the basket rim **22*b*. There is a loose fit between the inner edge of the gutter and the walls of groove 66 so the basket 22 is free to rotate relative to the gutter. An outlet 68 is present in the wall of housing 62 to allow liquid to drain from gutter 64**.

A second outlet 72 is provided in the wall of housing 62 below outlet 68 to allow liquid to drain from the bottom of the housing at the periphery of base 10 as will be described in more detail later.

The top of housing 62 may be closed by a removable dome-shaped cover 74 which seats on the upper edge of housing 62.

Finally, a feed pipe 76 extends down through the housing cover 74 and through the central opening **54*a* in the basket cover 54 so that the lower or exit end 76*a* of the feed pipe is spaced above the top of accelerator 42 at the bottom of basket 22. Preferably the feed pipe 76 has a reduced diameter, e.g., 2 inch ID, and its end 76*a* spaced about 2 inches from accelerator 42**.

During operation of the centrifuge, shaft 14 and basket 22 are rotated in a given direction, e.g., clockwise, at a high speed, e.g., 18,000 RPM, and a feed liquid or slurry is pumped through feed pipe 76 into the rotating basket, or more particularly, into the liner 52 therein. Usually the incoming liquid contains a solid phase and a liquid phase. For example, the feed liquid may be a grinding lubricant from a grinding machine that is being recycled to remove metal particles and debris from the lubricant so that the lubricant can be reused. In any event, the feed liquid issues from the feed pipe end **76*a* at a relatively high velocity and encounters the conical feed accelerator 42 which is rotating at the same speed as basket 22. The accelerator immediately redirects the incoming liquid radially outward toward the radially outer wall of liner 52** and also imparts angular velocity to the feed stream causing that liquid to accelerate up to the speed of the rotating basket.

As the feed liquid continues to flow into the basket, due to centrifugal forces, it collects as an annular pool P adjacent to the side wall of liner 52. As more liquid flows into the basket, the inner diameter of the annular pool P becomes smaller and smaller until the pool reaches the opening **55*a* in cover 55, at which point liquid begins to discharge through that opening and is thrown out into the gutter 64 and drained away through outlet 68. All of this escaping liquid is devoid of metal particles because, being relatively heavy, those solids are thrust by centrifugal force against the side wall of liner 52 where they accumulate as a cake. Thus, only the liquid phase of the feed liquid is discharged from basket 22 into gutter 64**.

Once basket 22 has been filled with feed liquid as aforesaid, the centrifuge operates in a more or less steady state mode wherein a certain volume of feed liquid enters the basket and almost the same volume of liquid phase fluid is discharged from the basket, the difference being the volume of solids accumulating on the liner 52.

It is important to note that even during the steady state operation of the centrifuge when the liquid pool in basket 22 has maximum width as shown in FIG. 3, the incoming feed liquid is accelerated both radially and circumferentially by accelerator 42 so that the liquid is able to penetrate the inner surface of the liquid pool P and deep into the pool thus ensuring distribution of that liquid to the outer wall of the liner 52 where the liquid and any particulates therein are subjected to maximum G-forces. Therefore, the centrifugal separation .effect on the liquid will be a maximum.

It is important to note also that the incoming feed stream has a high velocity upon encountering accelerator 42. Therefore, a minimal amount of air is entrained in the liquid so that there is a minimum windage effect on the feed stream. Moreover, because the exit **76*a* end of the feed tube is located right adjacent to the bottom of basket 22 and the feed stream is accelerated immediately by accelerator 42 out to the side wall of liner 52, the liquid spends a maximum amount of time in the radially outer regions of the basket before being discharged from the basket through top opening 54*a***. This long residence time in the outer regions of the basket assures that the liquid phase leaving the basket will be devoid of even small solids.

At some point, the amount of solids accumulated on liner 52 will become excessive necessitating that the centrifuge be turned off so that the solids can be removed from the liner. With the present centrifuge, it is not necessary to manually remove the liquid remaining in liner 52 in order to perform that chore. Rather, this centrifuge is self-draining. More particularly, as seen from FIG. 3, when the centrifuge basket 22 is spinning, the inner diameter of the liquid pool P can never be less than the diameter of the discharge opening **54*a* due to the centrifugal force applied to the liquid by the spinning basket. However, when the basket 22 stops, the annular column of liquid within liner 52 will collapse and the residual liquid will settle at the bottom of the liner where the liquid is now free to drain out through the drain holes 28 and drain passages 32 from which it will be discharged onto the inclined surface 10*a* of base 10 and flow away from shaft bearing 16*a* to the periphery of base 10. There, it will drain away through outlet 72**. Since this residual liquid may contain metal particulates and other solids, it is usually recycled through the centrifuge.

Actually, the residual liquid starts draining from basket 22 even before the basket stops because a vacuum is created in the drain passages 78 due to the rotation of those passages with the basket. As soon as the force exerted on the liquid by that negative pressure overcomes the centrifugal force on the liquid at the bottom of line 52, liquid is drawn out through the drain passages 32 and flung radially outward onto base surface **10*a*. Thus, the time to drain the residual liquid from basket 22** is kept to a minimum.

After the centrifuge has stopped and substantially all of the residual liquid has drained from liner 52, the liner may be removed from basket 22 by removing the fasteners 56. As some minimum amount of liquid may remain in basket 22 under filter 52, the extra drain holes 34 are provided to drain away any such remaining liquid.

It will thus be seen that the objects set forth among those made apparent from the preceding description are efficiently attained and, since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention described herein.

What is claimed is:

1. A centrifuge comprising:

a generally cylindrical basket having a bottom wall, a side wall, and a top wall with a central opening and an axis of rotation;

a removable interior liner lining the bottom wall and side wall of the basket;

means for rotating said basket about said axis of rotation;

a feed pipe extending into said basket through said central opening therein, said feed pipe having an exit end spaced above said basket bottom wall at said axis for conducting a feed liquid to said basket;

a feed accelerator projecting from said basket bottom wall opposite said feed pipe exit end, said accelerator both having a surface sloped from said axis and being fixed for rotation with said basket so that when said basket is rotated, said accelerator will impart radial and angular acceleration to the feed liquid issuing from said feed pipe exit end so that said feed liquid is accelerated toward said basket side wall whereby said feed liquid forms an annular liquid pool that is spaced from said axis, said annular liquid feed pool containing at least one of a liquid phase and a solid phase; and liquid drain means in said basket bottom wall adjacent to said axis for draining of at least a portion of said liquid phase from said basket during rotation of said basket as the liquid pool separates into a liquid phase and a solid phase, and for draining all remaining said liquid phase when rotation of said basket is stopped and said liquid pool collapses, thereby leaving only said solid phase.

2. The centrifuge defined in claim 1 wherein said feed pipe extends more than half way into said basket along said axis so that said feed pipe exit end is spaced relatively close to said accelerator.

3. The centrifuge defined in claim 2 wherein said feed pipe has an inner diameter of two inches.

4. The centrifuge defined in claim 1 wherein said accelerator is a conical member whose apex is located substantially on said axis.

5. The centrifuge defined in claim 4 wherein said conical member has a 40°–60° incline.

6. The centrifuge defined in claim 4 and further including means defining one or more slots in the inclined surface of said conical member to facilitate imparting angular acceleration to said liquid.

7. The centrifuge defined in claim 6 wherein said conical member has four of said slots based 90° apart about said axis.

8. The centrifuge defined in claim 1 wherein said drain means comprise one or more liquid passages in said basket bottom wall, each passage having an entrance end in said basket adjacent to said axis and an exit end open at the underside of said basket and spaced radially outward from said axis and said corresponding entrance end.

9. A centrifuge comprising:

a generally cylindrical basket having a bottom wall, a side wall, and an axis of rotation;

an interior liner lining the bottom wall and side wall of the basket, the liner being selectively removable therefrom;

means for rotating said basket about said axis of rotation;

means for introducing a liquid into said basket along said axis of rotation so that when said basket is rotated, said liquid is propelled by centrifugal force toward said basket side wall where said liquid forms an annular liquid pool that is spaced from said axis whereby said feed liquid forms an annular liquid pool that is spaced from said axis, said annular liquid feed pool containing at least one of a liquid phase and a solid phase; and liquid drain means in said basket bottom wall adjacent to said axis for draining of at least a portion of said liquid phase from said basket during rotation of said basket as the liquid pool separates into a liquid phase and a solid phase, and for draining all remaining said liquid phase when rotation of said basket is stopped and said liquid pool collapses, thereby leaving only said solid phase.

10. The centrifuge defined in claim 9 wherein said drain means comprise one or more liquid passages in said basket bottom wall, each passage having an entrance end in said basket adjacent to said axis and an exit end opening to the underside of said basket at a location spaced radially out from said axis and from said corresponding passage entrance end.

11. The centrifuge defined in claim 10 wherein said rotating means comprise a driven rotary shaft mounted in a base for rotation about a vertical axis, said base having an upper surface with a vertical incline so that when liquid drains from the exit end of each passage, it is conducted by said surface away from said rotary shaft.

12. The centrifuge defined in claim 9 and further including means for imparting angular and radial acceleration to the liquid introduced into said basket by said introducing means so that said liquid is propelled toward said basket side wall.

13. A centrifuge comprising:

a generally cylindrical basket having a bottom wall, a side wall, and a top wall with a central opening and an axis of rotation;

a removable interior liner lining the bottom wall and side wall of the basket;

a feed pipe having an exit end substantially centered in and extending through said central opening into said basket for conducting a feed liquid to said basket;

a conical-shaped feed accelerator projecting from said basket bottom wall opposite said feed pipe exit end, said accelerator being fixed for rotation with and at the same speed as said basket so that when said basket is rotated, said accelerator will impart radial and angular acceleration to the feed liquid issuing from said feed pipe so that said feed liquid is accelerated toward said basket side wall whereby said feed liquid separates into a solid phase along the side wall and a liquid phase adjacent thereto and in closer proximity to the axis of rotation; and liquid drain means solely in said basket bottom wall for draining of at least a portion of said liquid phase from said basket during rotation of said basket, and for draining all remaining said liquid phase when rotation of said basket is stopped, thereby leaving only said solid phase.

14. The centrifuge defined in claim 13 wherein a diameter of said basket is less than twenty-four inches.

15. The centrifuge defined in claim 13 wherein said basket is rotated at approximately 18,000 revolutions per minute.

16. The centrifuge defined in claim 13 wherein said conical-shaped feed accelerator is inclined from the axis of rotation at between 40° and 60°.

17. The centrifuge defined in claim 16 wherein said conical-shaped feed accelerator is approximately four inches in diameter and approximately two inches high.

18. The centrifuge defined in claim 16 wherein the incline is approximately 50°, a diameter of said basket is less than twenty-four inches, said basket is rotated at approximately 18,000 revolutions per minute, said feed pipe is two inches in inside diameter, and said accelerator is approximately four inches in diameter and approximately two inches high.

19. The centrifuge defined in claim 13 wherein the feed pipe is two inches in inside diameter.

* * * * *